United States Patent [19]

Oshima et al.

[11] Patent Number: 4,630,969

[45] Date of Patent: Dec. 23, 1986

[54] ARTIFICIAL ISLAND

[75] Inventors: Masanao Oshima, Tokyo; Nobuyoshi Yashima, Funabashi, both of Japan

[73] Assignee: Mitsui Engineering & Shipbuilding Co., Ltd., Tokyo, Japan

[21] Appl. No.: 593,720

[22] Filed: Mar. 23, 1984

[30] Foreign Application Priority Data

Apr. 18, 1983 [JP] Japan ..... 58-66981

[51] Int. Cl.[4] ..... E02D 21/00

[52] U.S. Cl. ..... 405/217; 405/211

[58] Field of Search ..... 405/61, 211, 212, 216, 405/217, 195, 130; 175/9; 62/260

[56] References Cited

U.S. PATENT DOCUMENTS

| | | | |
|---|---|---|---|
| 3,738,114 | 6/1973 | Bishop | 405/217 |
| 3,798,912 | 3/1974 | Best et al. | 405/61 |
| 4,094,149 | 6/1978 | Thompson et al. | 405/130 |
| 4,187,039 | 2/1980 | Jahns et al. | 405/61 X |
| 4,260,292 | 4/1981 | Steddum et al. | 405/61 X |
| 4,283,161 | 8/1981 | Evans et al. | 405/216 |
| 4,427,320 | 1/1984 | Bhula | 405/217 X |
| 4,431,346 | 2/1984 | Husebye | 405/217 |
| 4,456,072 | 6/1984 | Bishop | 405/61 X |
| 4,464,083 | 8/1984 | Wathey | 405/217 X |

FOREIGN PATENT DOCUMENTS

| | | | |
|---|---|---|---|
| 20831 | 2/1980 | Japan | 405/217 |
| 75011 | 6/1980 | Japan | 405/217 |
| 79089 | 6/1981 | Japan | 405/217 |
| 150211 | 11/1981 | Japan | 405/217 |
| 12714 | 1/1982 | Japan | 405/211 |

OTHER PUBLICATIONS

"Ice Island for Arctic Drilling Proposed", The Oil and Gas Journal", Sep. 14, 1970, pp. 60–61.

*Primary Examiner*—Cornelius J. Husar
*Assistant Examiner*—Nancy J. Stodola
*Attorney, Agent, or Firm*—Browdy and Neimark

[57] ABSTRACT

Inclined plane protection boards are provided in a manner to cover an inclined plane of an artificial island whereby the inclined plane may be protected from ice force of growing or drifting ice bodies or wind and wave force.

1 Claim, 7 Drawing Figures

ARTIFICIAL ISLAND

BACKGROUND OF THE INVENTION

The present invention relates to the structure of an artificial island used for an oil drilling station or the like. More particularly, it relates to improvements in the artificial island, thereby protecting the artificial island where the surrounding sea may be frozen or drifting ice bodies surge during the winter months from ice force of growing or surging ice bodies.

Generally, an inclined plane is formed around an artificial island where the surrounding sea may be frozen or drifting ice bodies may surge during the winter months in order to reduce ice force and thereby to protect the artificial island from growing or surging ice bodies. Said artificial island may be in the shape of conical trapezoid.

Heretofore, sandbags have been employed and embedded in the inclined planes in order to protect the inclined plane from the ice force of the growing or surging ice bodies.

However, such a protection measure is insufficient for reducing the ice force. As a result, the artificial island may be greatly damaged due to the ice force of the growing or surging ice bodies. Repair of the artificial island is therefore necessary once for every winter.

BRIEF SUMMARY OF THE INVENTION

In an artificial island having an inclined plane or surface therearound, the characteristic of the present invention is such that a plurality of inclined plane protection boards or surface protection members are provided in a manner to cover the surface of said inclined plane.

According to the present invention, the inclined plane so formed around the artificial island as to reduce ice force may securely be protected from the ice force of growing or surging ice bodies by means of the inclined plane protection boards. Thereby, damage of the artificial island may be prevented and the artificial island may not be in need of repair annually.

BRIEF DESCRIPTION OF THE DRAWINGS

FIG. 1 is a perspective view, partially broken away, of the artificial island;

FIG. 2 is an enlarged view showing the principal part of a first embodiment;

FIG. 3 is an enlarged view showing the principal part of a second embodiment;

FIG. 4 is an enlarged view showing the principal part of a third embodiment;

PREFERRED EMBODIMENTS OF THE INVENTION

Figure 1:
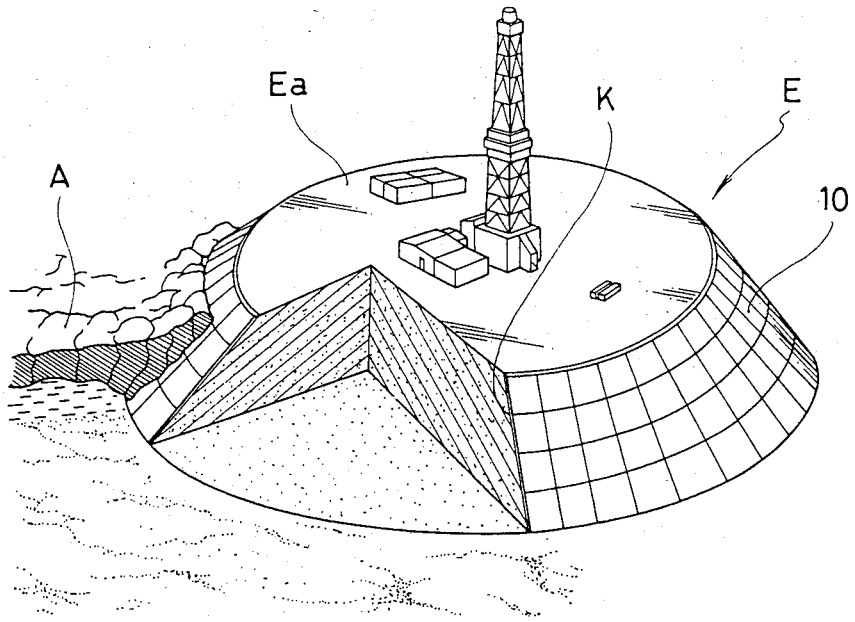
FIG. 1 to FIG. 4 illustrate an artificial island according to each embodiment of the present invention.

The reference character E denotes an artificial island according to an embodiment of the present invention, a body Ea comprising a mass of solid material typically in the shape of a truncated conical. The construction of the artificial island E is such that an inclined plane K, defined by the solid material, is formed therearound in order to reduce ice force and a plurality of inclined plane protection boards are provided in a manner to cover the surface of the inclined plane K.

The construction of the artificial island E is further described hereinbelow. The inclined plane protection boards or surface protection members 10 are provided in a manner to cover the surface of the inclined plane or surface K so as to prevent damage of said inclined plane K due to the ice force of growing or surging ice bodies or surging wind and waves. In addition, said inclined plane protection boards 10 are provided to prevent direct application of the ice force of the growing or surging ice bodies to the artificial island body Ea by pressing the end portions of the drifting ice bodies onto the surface of the inclined plane protection boards 10, bending them upward along the surface of the inclined plane protection boards 10 and thereby breaking the ice bodies.

The inclined plane protection board may preferably be made of iron, steel, stainless steel or other durable materials. Further, the surface of the inclined plane protection board 10 may be treated or coated with synthetic resin so as to be slippery.

Figure 2:
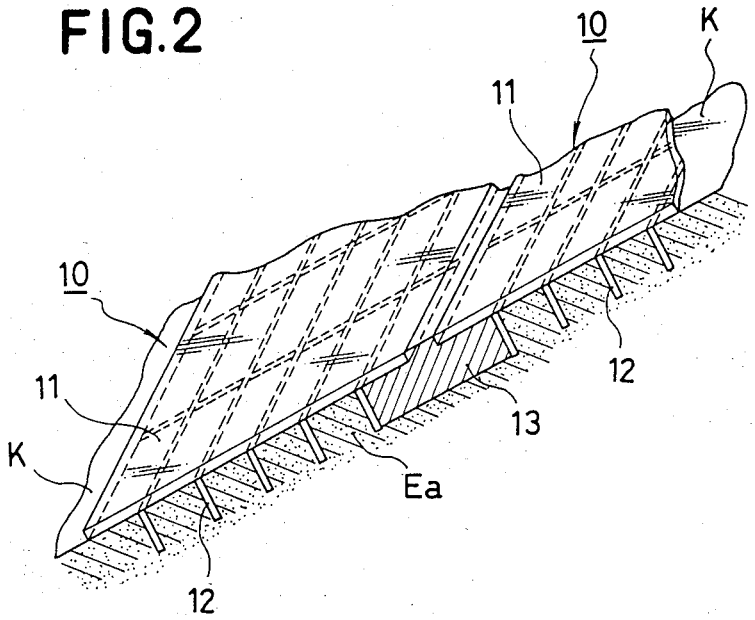

In a first embodiment of the present invention as shown in FIG. 2, the construction of the inclined plane protection board 10 is such that fixing members or anchoring parts 12 are provided in a grid-like pattern underneath a protection member or slate body sheet 11. Upon executing the inclined plane protection board 10 in the inclined plane K of the artificial island body Ea, the protection member 11 is embedded therein in the mass of solid material and as illustrated, mortar 13 is utilized for filling each space between the inclined plane protection boards 10, thereby preventing the inclined plane protection boards 10 from being separated from the inclined plane K due to the ice force of the growing or surging ice bodies or the surging wind and waves.

Figure 3:
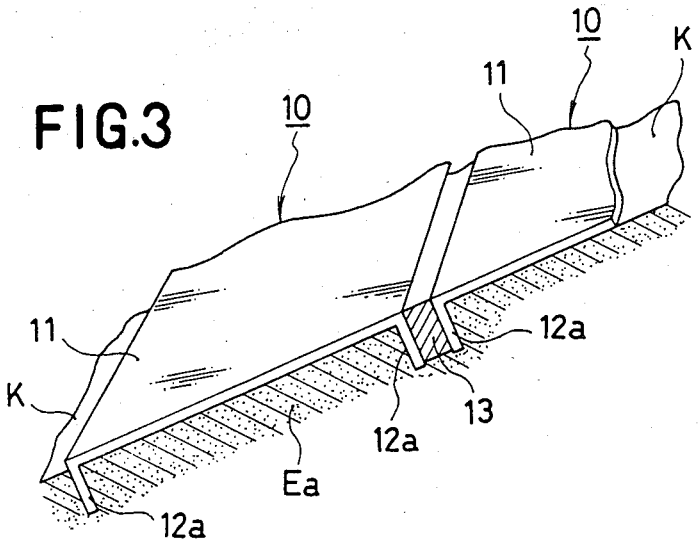

In a second embodiment of the present invention as shown in FIG. 3, the construction of the inclined plane protection board 10 is such that the protection member 11 is integrally formed with fixing members **12*a*** underneath the side edges thereof as illustrated.

Upon disposing the inclined plane protection board 10 in the inclined plane K of the artificial island body Ea, the fixing members **12*a* are embedded therein and as illustrated, the mortar 13** is injected into each space between the inclined plane protection boards for the fixation thereof, thereby preventing the inclined plane protection boards from being separated from the inclined plane K due to the ice force of the growing or surging ice bodies or the surging wind and waves.

Figure 4:
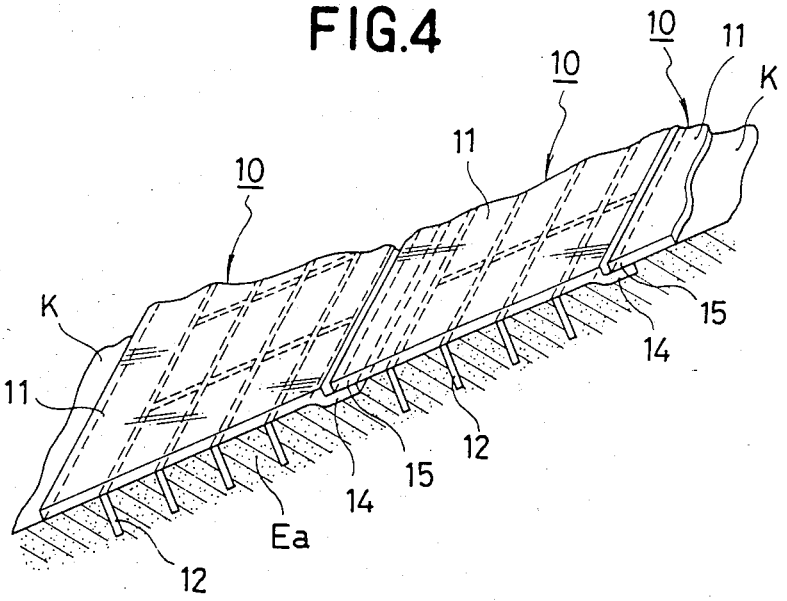

Further, in a third embodiment of the present invention as shown in FIG. 4, the construction of the inclined plane protection board 10 is such that the fixing members 12 are provided in the form of a grid underneath the protection member 11. An engaging step portion 14 is formed at a side edge of the protection member 11. Upon disposing the inclined plane protection board 10 in the inclined plane K of the artificial island body Ea, said fixing members 12 are embedded therein and the engaging step portion 14 of the inclined plane protection board 10 is engaged with a side edge 15 of the adjacent inclined plane protection board 10, said side edge 15 being in the absence of the engaging step portion 14. Thereby, separation of the inclined plane protection board 10 from the inclined plane K due to the ice force of the growing or surging ice bodies or the surging wind and waves may be prevented.

The protection member or plate body sheet 11 may be of fan shape, a shape corresponding to a segment of the surface of a conical body. However, it may be square or rectangular or it may be of other shapes depending upon the construction. Furthermore, the fixing member 12 acts as an anchor and the size and number thereof is preselected in order to endure against external force such as the ice force and the like.

Figure 5:
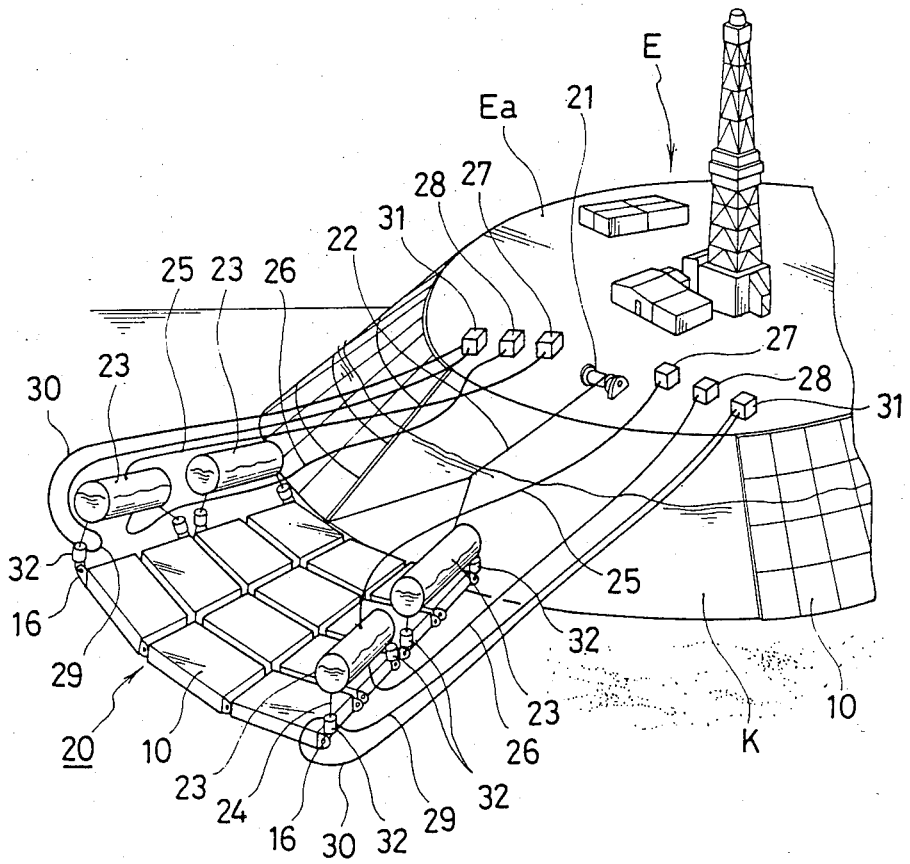
FIG. 5 explains an execution method according to a fourth embodiment.

FIG. 5 illustrates a fourth embodiment of the present invention. A plurality of the inclined plane protection boards including plate body sheets 11 (FIG. 6), are interconnected so as to form an assemblage body 20, said assemblage body 20 being equipped with a plurality of flotation bodies 23 at the sides thereof. The assemblage body 20 may be towed to the destination in a floating state. Further, the assemblage body 20 is towed to a predetermined place by winding a wire 22 by means of a winch 21 mounted on the artificial island E. Thereafter, the assemblage body 20 may be sunk by supplying water to each of the flotation bodies 23 whereby the assemblage body 20 is set in the inclined plane K of the artificial island E. After each of the flotation bodies 23 is disconnected from the assemblage body 20, it may again be floated by supplying air thereto and may thereby be collected.

Figure 6:
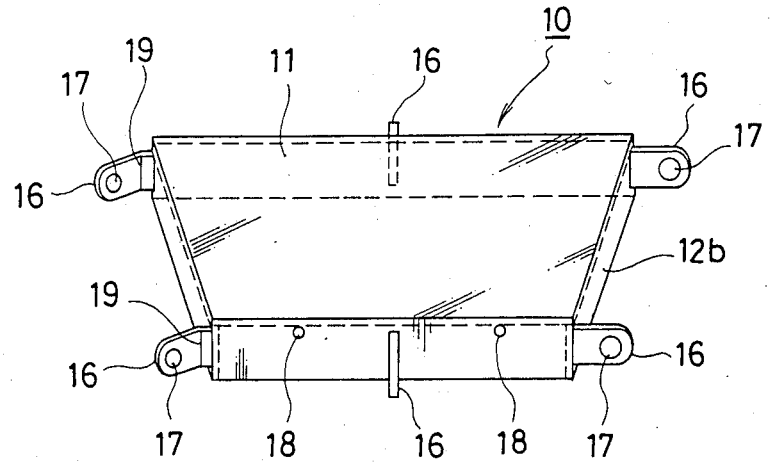
FIG. 6 is a perspective view of an inclined plane protection board to be used upon the execution of FIG. 5.

As shown in FIG. 6, each of the inclined plane protection boards 10 carries connecting parts 16 with holes 17 at each side thereof. The inclined plane protection board 10 may be interconnected with the adjacent inclined plane protection boards by means of connecting members such as bolts, wire and the like. In this connection, each of the connecting parts 16 includes a bent portion 19 therein whereby the inclined plane protection board 10 may readily be connected with the adjacent inclined plane protection board 10 at the left side thereof.

In this example, the protection member or plate body sheet 11 is of fan shape and fixing members **12*b* are fixed to the surroundings of the protection members or plate body sheet 11. Further, the fixing members 12*b* are formed with air vents 18**.

Each of the flotation members 23 carries hoses 25, 26. When the assemblage body 20 is necessary to be sunk, the water is supplied to the flotation members 23 from a water supply unit 28 through the hose 26. On the other hand, when necessary to be floated, air is supplied to the flotation bodies 23 from an air supply unit 27 through the hose 25.

As shown in FIG. 5, a disconnecting unit 32 connected to the flotation bodies 23 via a wire 24 is connected to the connecting part 16 of the inclined plane protection board 10. Said disconnecting unit 32 may be separated from the connecting part 16 when a part of claws 35 in the disconnecting unit 32 are opened.

Figure 7:
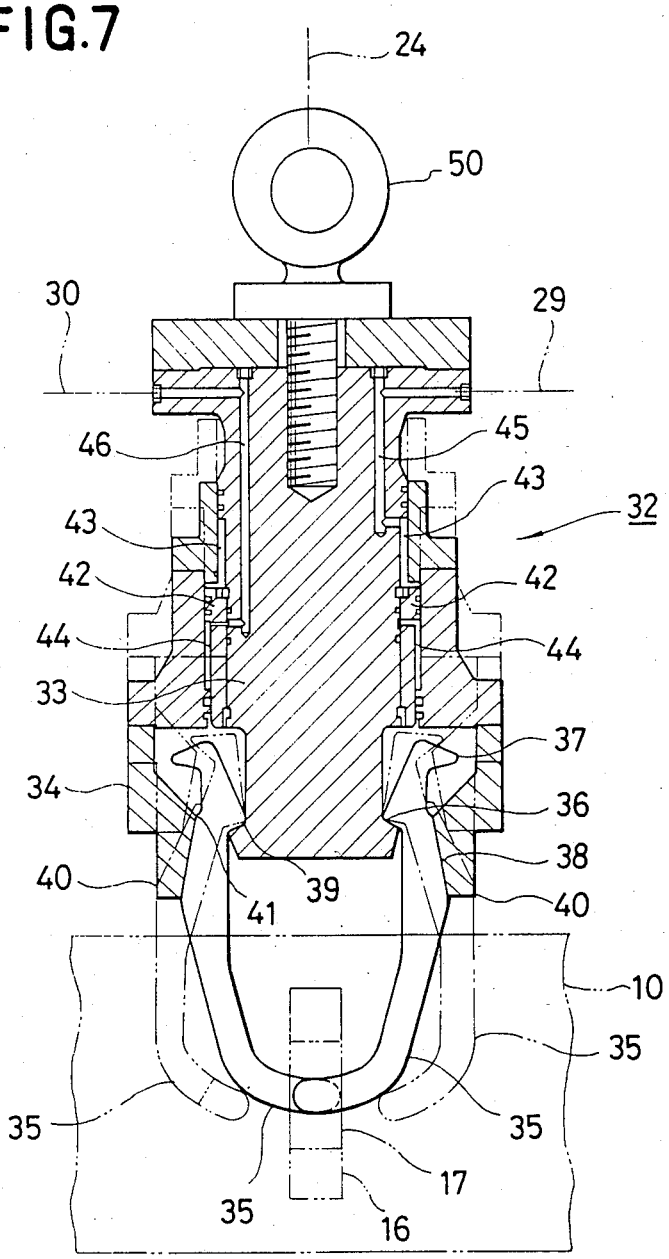
FIG. 7 is a sectional view of a disconnecting unit.

As shown in FIG. 7, hooks 36 of each of the claws 35 in the disconnecting unit 32 rest on step portions 39 formed at the lower part of a disconnecting body 33. A rear portions 38 of the hooks 36 are supported by beaks 40 at the lower part of moving portions 34 slidably mounted to the disconnecting body 33. Additionally, projections 37 are formed respectively at the upper part of each of the claws 35. Said projections 37 are adapted to be biased by biasing portions 41 of the beaks 40.

Said disconnecting body 33 is provided with a ring-like separation walls 42 substantially at the central part thereof. A first pair of cylinders 43 are respectively located between the disconnecting body 33 and the moving portions 34 and above the separation walls 42 and a second pair of cylinders 44 are respectively located therebelow.

The first cylinder 43 communicates with a passage 45 and a tube 29 respectively formed within the disconnecting body 33. On the other hand, the second cylinders 44 communicates with a passage 46 and a tube 30 respectively formed within the disconnecting body 33. These tubes 29, 30 further communicate with a hydraulic fluid supply unit 31.

Additionally, a ring 50 is formed at the upper part of the disconnecting body 33 whereby the wire 24 may be connected thereto.

When hydraulic fluid is supplied to the second cylinder 44 from the passage 46, the moving portions 34 move downward and the beaks 40 press the rear portions 38 of each of the claws 35. Thereby, the claws 35 are closed so as to hold the connecting part 16 of the inclined plane protection board 10 as shown in the actual line.

On the other hand, when the hydraulic fluid is supplied to the first cylinder 43 from the passage 45, the moving portions 34 move upward and the biasing portions 41 of the beaks 40 bias the projections 37 of each of the claws 35. Thereby, the claws 35 are opened to separate the disconnecting body 33 from the connecting part 16 of the inclined plane protection board 10 as shown in the broken line.

As stated above, according to the present invention, in the artificial island having the inclined plane thereround, a plurality of the inclined plane protection boards are provided in a manner to cover the inclined plane, so that the inclined plane is so formed around the artificial island as to reduce the ice force and to very securely protected the island from the ice force of the growing or surging ice bodies, or the surging wind and waves by means of the inclined plane protection boards.

Accordingly, the present invention facilitates the ice force reducing effect of the inclined plane. Further repair of the artificial island is unnecessary for a long period of time and therefore, it is economical.

What is claimed is:

1. An artificial island comprising:

a mass of solid material defining an inclined surface about the periphery thereof;

a plurality of plate body sheets having a top surface and an underside;

a plurality of surface protection members covering said inclined surface, each of said surface protection members comprising a plurality of plate body sheets, and anchoring means for fixing said plate body sheets to said inclined surface fixed to and downwardly extending from the underside of said plate body sheets through said inclined surface, said anchoring means being secured within said mass of solid material, said anchoring means including a grid comprising a plurality of interconnected supports fixed to and depending downwardly from said plate body sheets and secured within said mass of solid material.

* * * * *